US006016930A

United States Patent [19]

Mathes et al.

[11] Patent Number: 6,016,930

[45] Date of Patent: Jan. 25, 2000

[54] CHILD-RESISTANT ADAPTER BAND

[75] Inventors: Todd E. Mathes, Newburgh; Randall G. Bush, Evansville, both of Ind.

[73] Assignee: Rexam Plastics Inc., Evansville, Ind.

[21] Appl. No.: 09/015,173

[22] Filed: Jan. 29, 1998

[51] Int. Cl.[7] ..... B65D 50/02; B65D 55/12; B65D 41/62

[52] U.S. Cl. ..... 215/216; 215/219; 215/252; 215/274

[58] Field of Search ..... 215/252, 258, 215/274, 276, 228, 330, 201, 216, 217, 218, 219, 221

[56] References Cited

U.S. PATENT DOCUMENTS

| | | |
|---|---|---|
| 3,464,576 | 9/1969 | Rohde . |
| 3,901,400 | 8/1975 | Westfall . |
| 3,915,326 | 10/1975 | Hrubesky . |
| 4,519,516 | 5/1985 | Amos . |
| 4,576,298 | 3/1986 | Boik . |
| 4,610,367 | 9/1986 | Massott et al. . |
| 4,643,321 | 2/1987 | Gach . |
| 4,694,970 | 9/1987 | Hayes . |
| 4,746,026 | 5/1988 | Leonhardt . |

*Primary Examiner*—Stephen K. Cronin
*Assistant Examiner*—Nathan Newhouse
*Attorney, Agent, or Firm*—Middleton & Reutlinger; John F. Salazar; Charles G. Lamb

[57] ABSTRACT

An adapter band for use on a closure, the closure being threadingly engageable with a container neck portion, the container neck portion having at least one locking ramp projecting therefrom, the adapter band providing an annular ring having a groove on an inner surface thereof, the groove being sized to receive an annular lip projecting outwardly from a lower end of the closure; a locking lug extending downwardly from the groove mateable with a recess in the annular lip; and, at least one locking tab projecting from the annular ring, the at least one locking tab being engageable with the at least one locking ramp provided on the container neck portion.

10 Claims, 13 Drawing Sheets

CHILD-RESISTANT ADAPTER BAND

BACKGROUND OF THE INVENTION

1. Technical Field of the Invention

The present invention relates to closures for use on containers. More particularly, the present invention relates to a closure for use on a container wherein a separate adapter band is mounted to the closure to convert an ordinarily non-child-resistant closure to a safety closure having child-resistant features.

2. Description of the Related Art

It is often desirable to provide a safety closure for use on a container wherein the safety closure and the container are respectively provided with cooperating locking means to inhibit access thereto by individuals of tender age. It is well-known in the prior art to threadingly fit a safety closure upon a neck portion of a container, wherein engageable locking lugs project from opposing mating portions of the safety closure and of the container neck, respectively. The cooperation of the engaged locking lugs and the threaded fit therebetween prevents removal rotation of the safety closure without first overcoming the engagement of the locking lugs. It is therefore desirable to provide a safety closure threadingly fit upon a container neck portion, wherein the safety closure and the container neck portion are provided with cooperating locking lugs.

However, engageable safety closures and container neck portions typical of those found in the prior art are pre-formed having the respective locking lugs integrally molded therewith. Thus, to utilize the locking lugs provided on a particular container neck portion, a specific safety closure having mating locking lugs must be formed and provided for use therewith. A closure not being provided with engageable locking lugs will not provide locking engagement with the container neck portion. Accordingly, it is desirable to provide an adapter band for use on an existing non-child-resistant closure to convert the non-child-resistant closure to a safety closure having child-resistant features, wherein the safety closure child-resistant features are engageable with cooperating child-resistant features provided on a container neck portion.

For example, U.S. Pat. No. 4,643,321 to Gach, and U.S. Pat. No. 4,746,026 to Leonhardt teach tamper-indicating bands for use on threaded caps. It is desirable, however, to further provide a tamper-indicating adapter band for use on an existing non-child-resistant closure to convert the non-child-resistant closure to a safety closure having child-resistant features, wherein the safety closure child-resistant features are engageable with cooperating child-resistant features provided on a container neck portion and wherein the adapter band provides an indication of tampering therewith.

It is even further desirable to provide an adapter band for use on an existing non-child-resistant closure to convert the non-child resistant closure to a safety closure having child-resistant features, wherein the adapter band is provided with means to convert a non-child-resistant container neck portion to a container neck portion having child-resistant features cooperable with the child-resistant features provided on the safety closure.

SUMMARY OF THE INVENTION

The present invention is for an adapter band for use on a non-child-resistant closure to convert the non-child-resistant closure to a safety closure having child resistant features, wherein the safety closure is for use on a container having cooperating child-resistant features to inhibit access thereto by individuals of tender age. The adapter band is secured to a lower end of an existing non-child-resistant closure in a manner sufficient to prevent relative rotational movement therebetween. For example, the adapter band may be thermally bonded to the closure or may be mechanically engaged therewith, such as, for example, by a plurality of interlocking lugs. The adapter band is provided with locking means, such as, for example, an outwardly-extending locking lug or a downwardly-projecting locking lug, for engaging a locking member provided on a container neck portion. The locking means, being fixedly secured to the closure, thereby converts the non-child-resistant closure to a safety closure having child-resistant features engageable with the locking member of the container neck portion. Removal of the safety closure from the container neck portion requires a user to first overcome the locking means. Alternatively, a tamper-indicating band portion may be provided on the adapter band for engagement with a cooperating bead provided on the container neck portion, thereby providing indication of tampering therewith. The tamper-indicating band portion may also be provided with a locking member to be fixedly secured to the container neck portion and engageable with the locking means of the adapter band, thereby converting a non-child-resistant container neck portion to a container neck portion having child-resistant features.

It is an object of the present invention to provide an adapter band for use on an existing non-child-resistant closure to convert the non-child-resistant closure to a safety closure having child-resistant features, wherein the child-resistant features of the safety closure are engageable with cooperating child-resistant features provided on a container neck portion.

It is another object of the present invention to provide an adapter band for use on an existing non-child-resistant closure to convert the non-child-resistant closure to a safety closure having child-resistant features, wherein the adapter band is provided with means for indicating tampering therewith.

It is yet another object of the present invention to provide an adapter band for use on an existing non-child-resistant closure to covert the non-child-resistant closure to a safety closure having child-resistant features, wherein the adapter band is provided with means to convert a non-child-resistant container neck portion to a container neck portion having child-resistant features cooperable with the child-resistant features provided on the safety closure.

An adapter band according to a preferred embodiment of the present invention and for use on a closure, the closure being threadingly engageable with a container neck portion, the container neck portion having at least one locking ramp projecting outwardly therefrom, the adapter band providing an annular ring having a groove on an inner surface thereof, the groove being sized to receive an annular lip projecting outwardly from a lower end of the closure; means for preventing rotational movement between the annular ring and the closure; and, at least one locking tab projecting from the annular ring, the at least one locking tab being engageable with the at least one locking ramp provided on the container neck portion.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
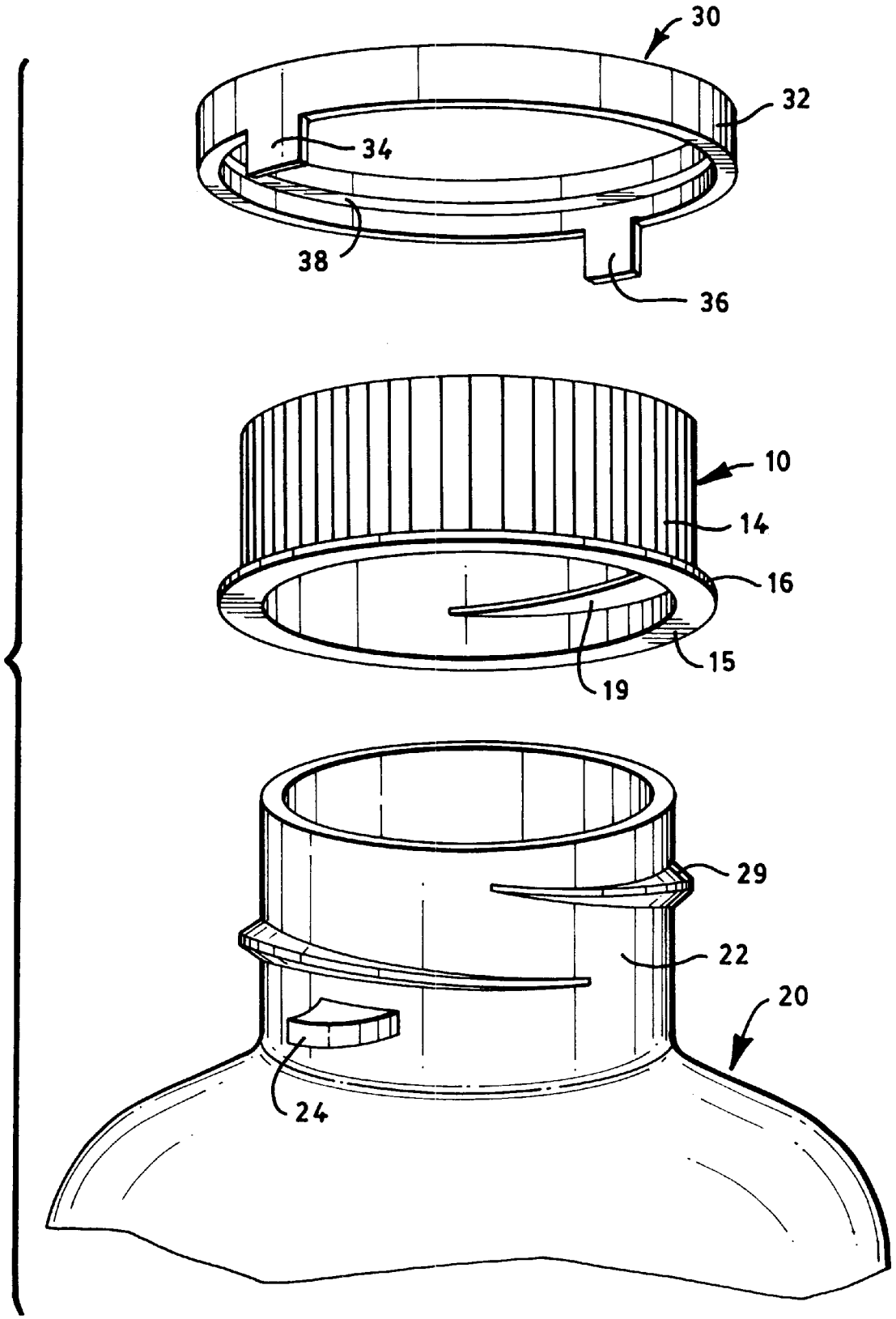
FIG. 1 is an exploded perspective view of an adapter band according to a preferred embodiment of the present invention shown with a non-child-resistant closure and a container neck portion.

With reference to FIG. 1, an adapter band 30 according to a preferred embodiment of the present invention for use on a non-child-resistant closure 10 includes a ring 32 having a continuous groove 38 on an inner surface thereof and a pair of locking tabs 34, 36 depending downwardly therefrom at diametrically-opposed annular locations. The closure 10 includes a top wall 12, an annular side wall 14 depending downwardly from an outer periphery of the top wall 12 and an annular lip 16 projecting radially outwardly from a lower end 15 of the side wall 14. The container 20 includes a neck portion 22 having a pair of locking ramps 24, 26 projecting radially outwardly from an outer surface of the neck portion 12. An external thread 29 projects radially outwardly from the outer surface of the neck portion and is sized and positioned to threadingly engage an internal thread 19 projecting inwardly from an inner surface of the closure side wall 14. The adapter band 30, the closure 20 and the container are all constructed from a light-weight, flexible material, such as, for example, polyethylene or polypropylene.

The adapter band 30 is positioned above the closure top wall 12 so that the locking tabs 34, 36 project downwardly towards the lower end 15 of the closure side wall 14. The adapter band 30 is then snap-fit downwardly onto the closure 10, such that the closure lip 16 seats within the groove 38 and secures the adapter band 30 thereto. The adapter band 30 may be secured to the closure 10 by any suitable means to prevent relative rotational movement therebetween, such as, for example, thermal bonding or gluing. However, the adapter band 30 may be secured to the closure 10 by any suitable mechanical means, such as, for example, as described hereinbelow and illustrated in FIGS. 4–7.

Figure 2:
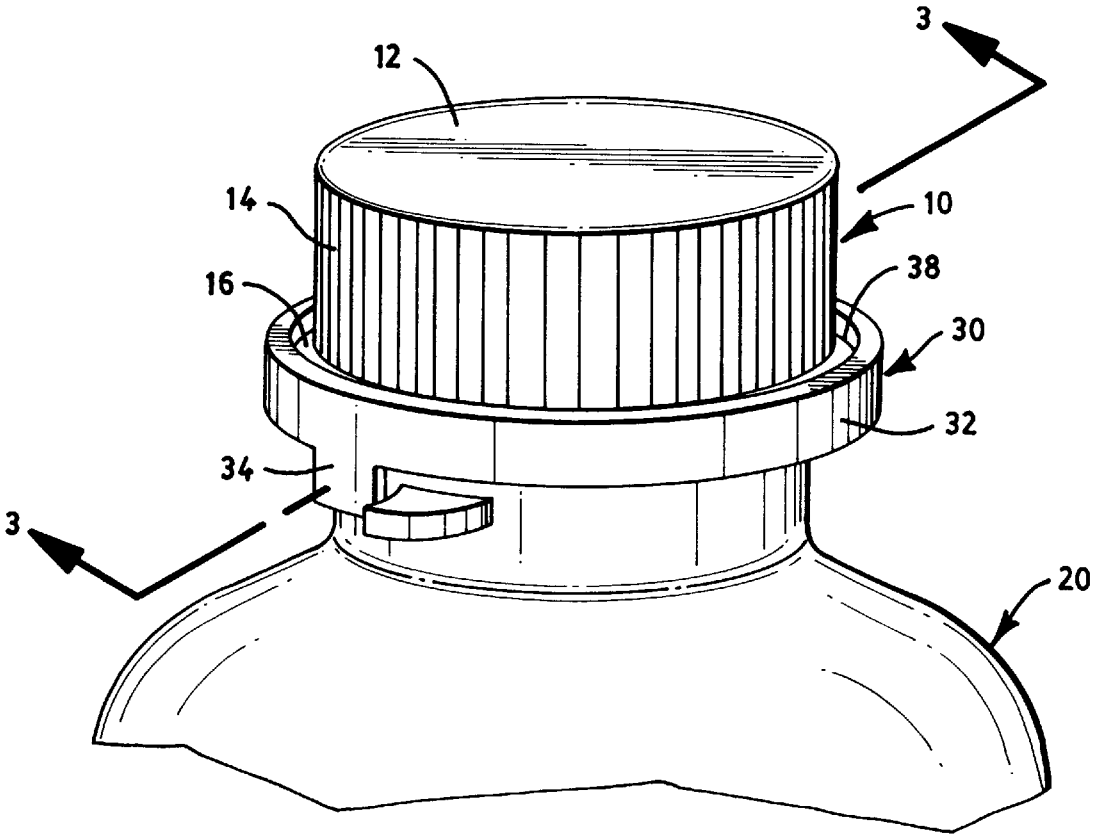
FIG. 2 is a perspective view of the adapter band of FIG. 1, shown attached to the non-child-resistant closure and affixed to the container neck portion.
Figure 3:
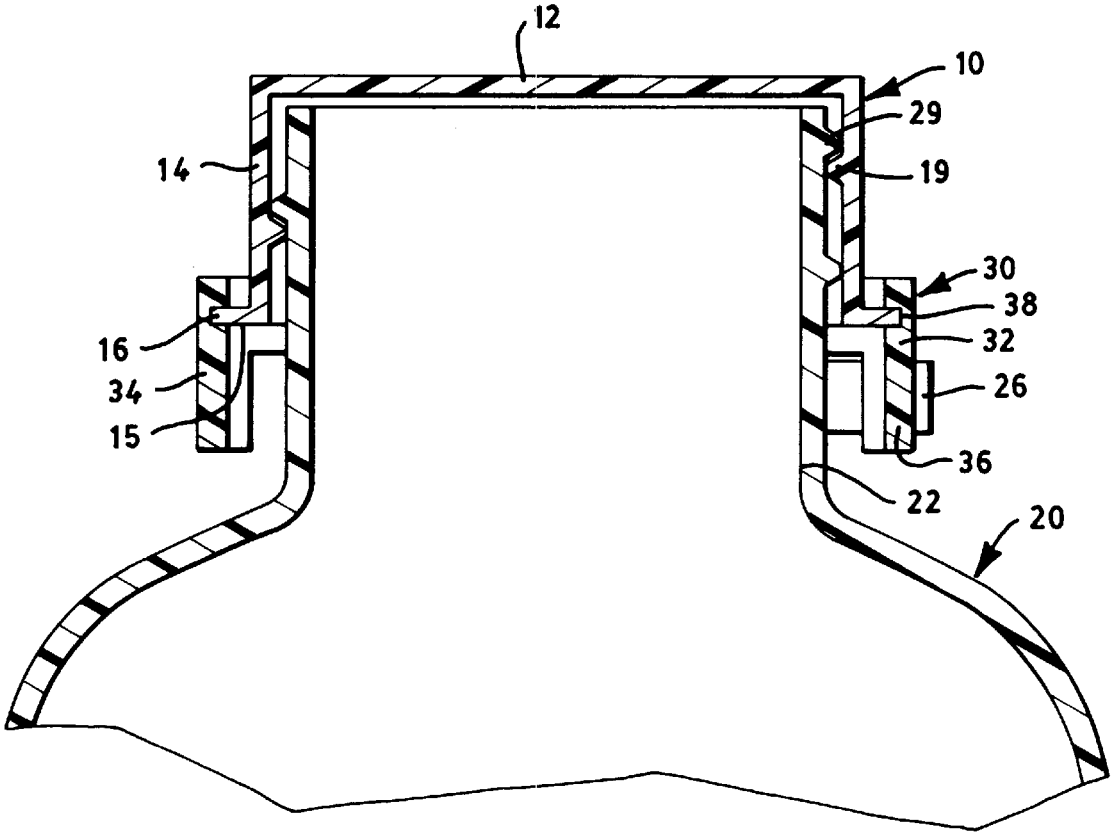
FIG. 3 is a section view of the adapter band of FIG. 2, taken along section line 3—3 of FIG. 2.
Figure 4:
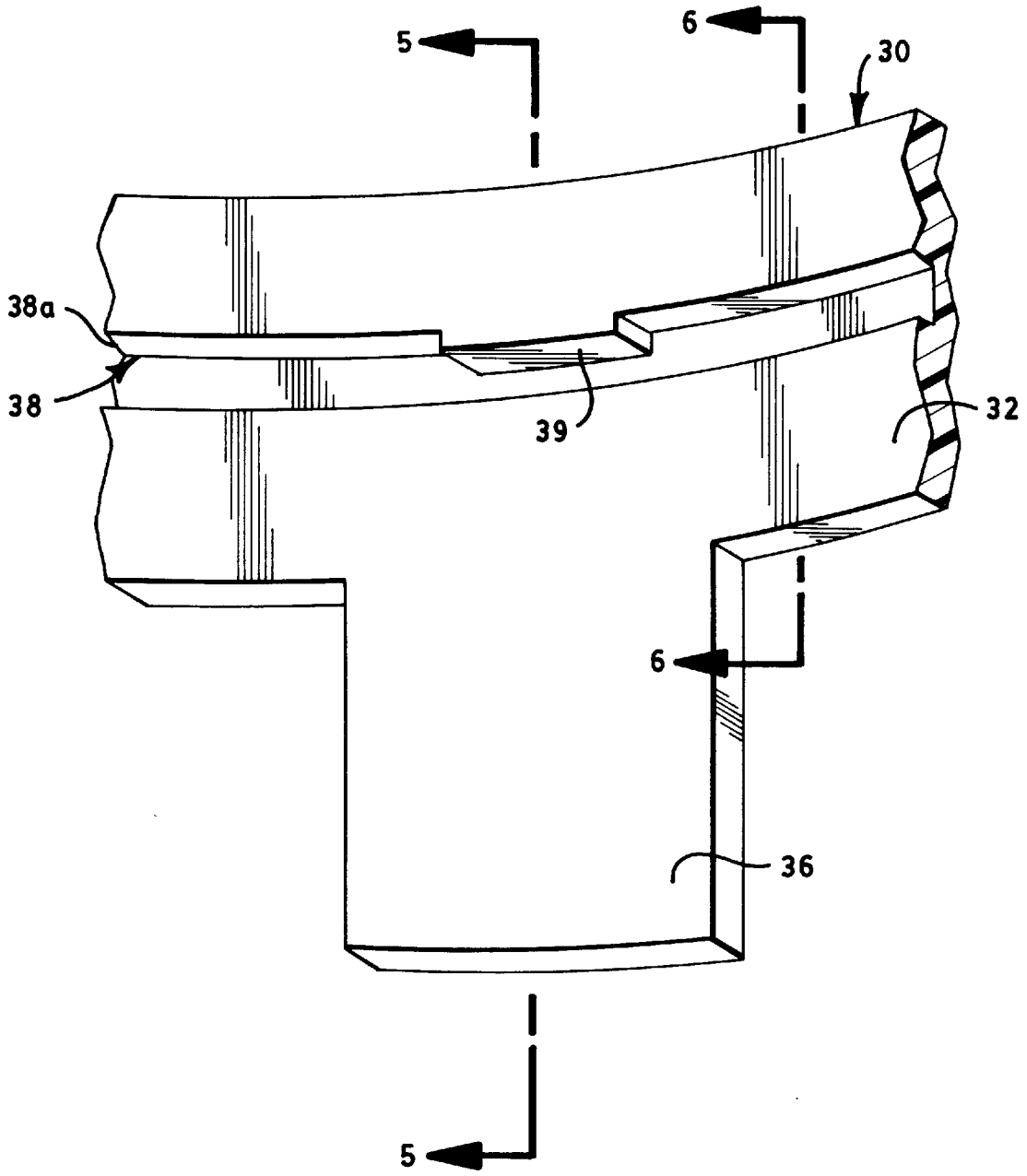
FIG. 4 is a detail view of one portion of the adapter band of FIG. 1.
Figure 5:
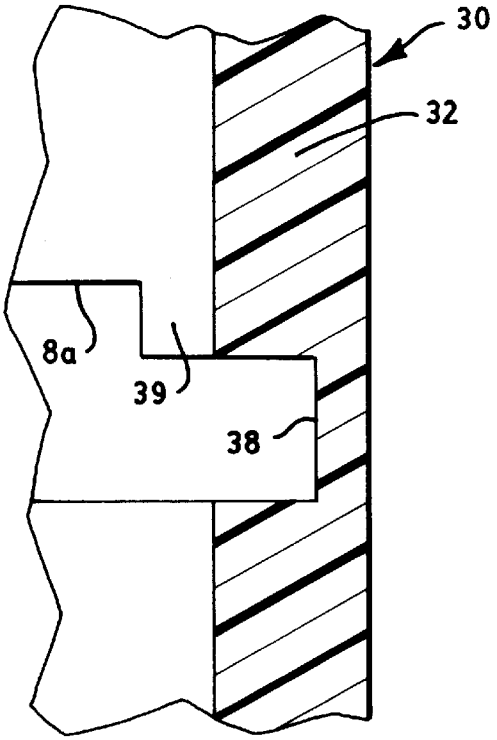
FIG. 5 is a detail section view of the adapter band of FIG. 4, shown taken along section line 5—5 of FIG. 4.
Figure 6:
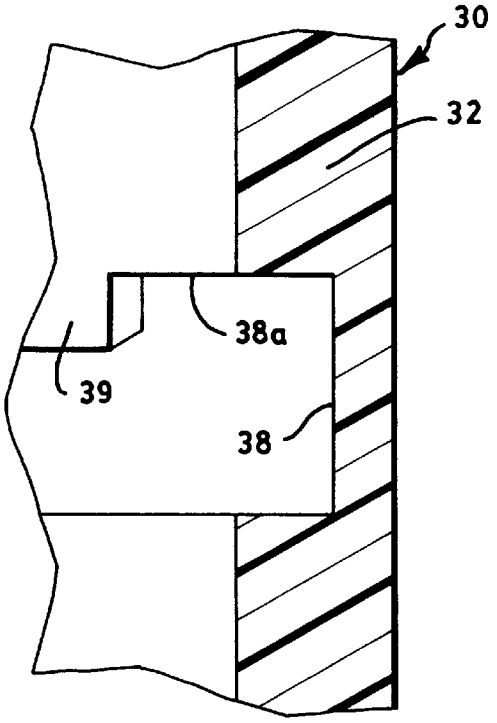
FIG. 6 is a detail section view of the adapter band of FIG. 4, shown taken along section line 6—6 of FIG. 4.
Figure 7:
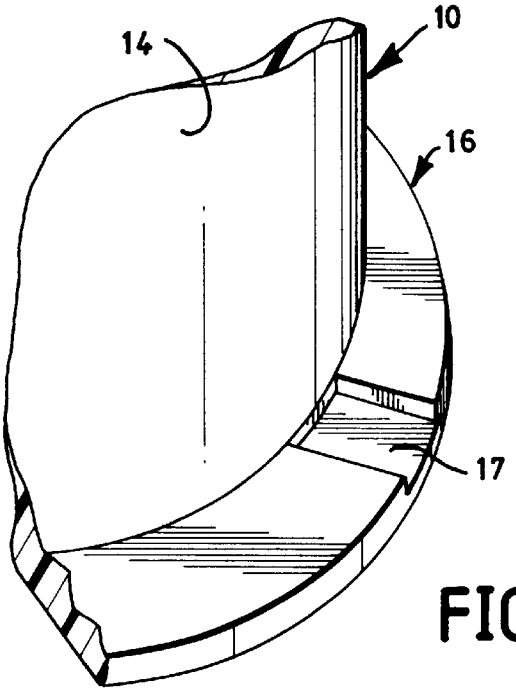
FIG. 7 is a detail section view of one portion of the closure of FIG. 1.

With respect to FIGS. 2 and 3, the closure 10 with the adapter band 30 secured thereto is threadingly engaged with the container neck portion 22 until the locking tabs 34, 36 pass over and beyond abutments 24*a*, 26*a* defined by a backside portion of the locking ramps 24, 26, respectively. The locking tabs 34, 36 seat behind their respective abutments 24*a*, 26*a*, thereby preventing removal rotation of the closure 10 relative to the container neck portion 22 unless each locking tab 34, 36 is moved from its normally-seated position to overcome its respective locking ramp 24, 26, such as, for example, by causing the locking tabs 34, 36 to move radially outwardly from the container neck portion 22.

Outward radial movement of the locking tabs 34, 36 can be accomplished by imparting inwardly-directed opposing radial forces to an outside surface of the side wall 14 at annular locations offset from the locations of the locking tabs 34, 36 by approximately 90°, whereat surface texturizing or knurling may be provided to enhance gripping thereof. Under the influence of these radial forces, the side wall 14 deforms radially inwardly thereabout, thereby causing the side wall 14 to deform radially outwardly at the locations of the locking tabs 34, 36. Once the locking tabs 34, 36 move radially outwardly a distance sufficient to permit their passing over the locking ramp abutments 24*a*, 26*a*, removal rotation of the closure 10 may be applied to threadingly remove the closure 10 from the container neck portion 22.

With reference to FIGS. 4–7, the adapter band 30 may be alternatively secured to the closure 10 (FIG. 2) to prevent relative rotational movement therebetween by mechanical means. More particularly, the continuous groove 38 may be provided with a plurality of lugs 39 depending downwardly therein from an upper surface 38*a* thereof. Preferably, four or more lugs 39 are spaced equidistantly around the annulus of the continuous groove 38, one of each such lugs 39 being aligned with each such locking tab 34, 36. The annular lip 16 of the closure includes a plurality of recesses 17 sized and spaced to receive the plurality of lugs 39 therein. The adapter band 30 is therefore removably snap-fit onto the closure 10 in a manner which provides simultaneous rotational movement and transmission of torque between the adapter band 30 and the closure 10.

Figure 8:
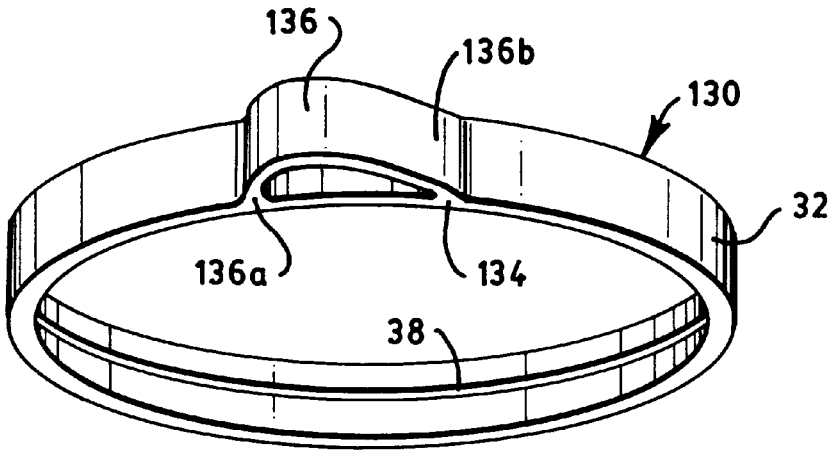
FIG. 8 is a perspective view of an adapter band according to another alternative embodiment of the present invention.
Figure 9:
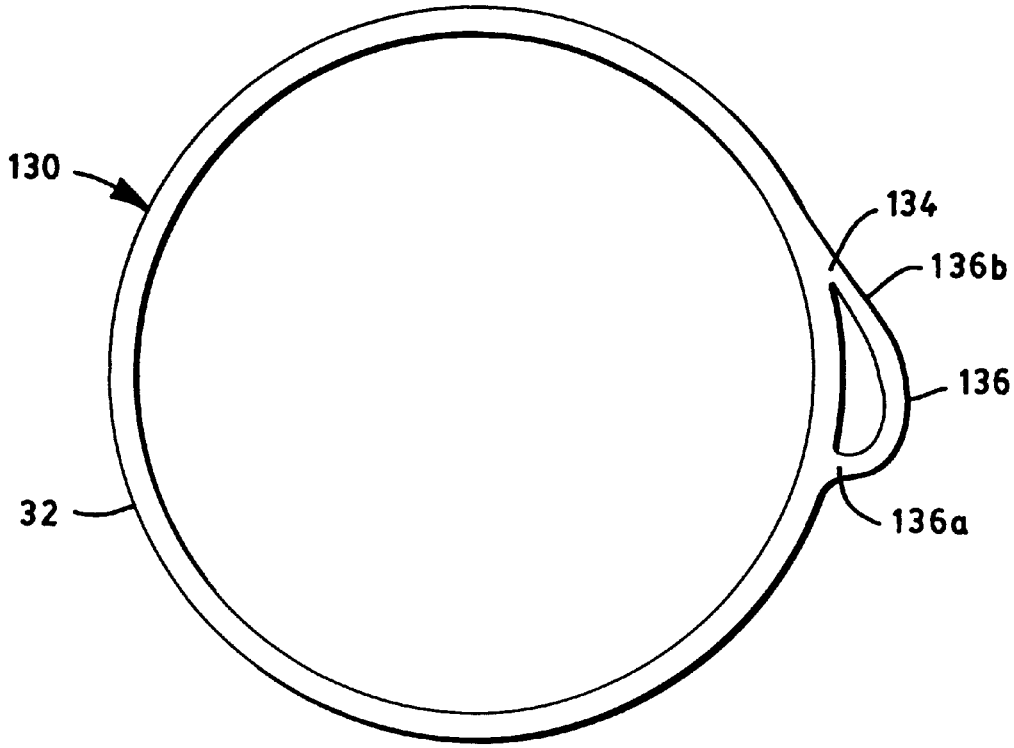
FIG. 9 is a top view of the adapter band of FIG. 8.
Figure 10:
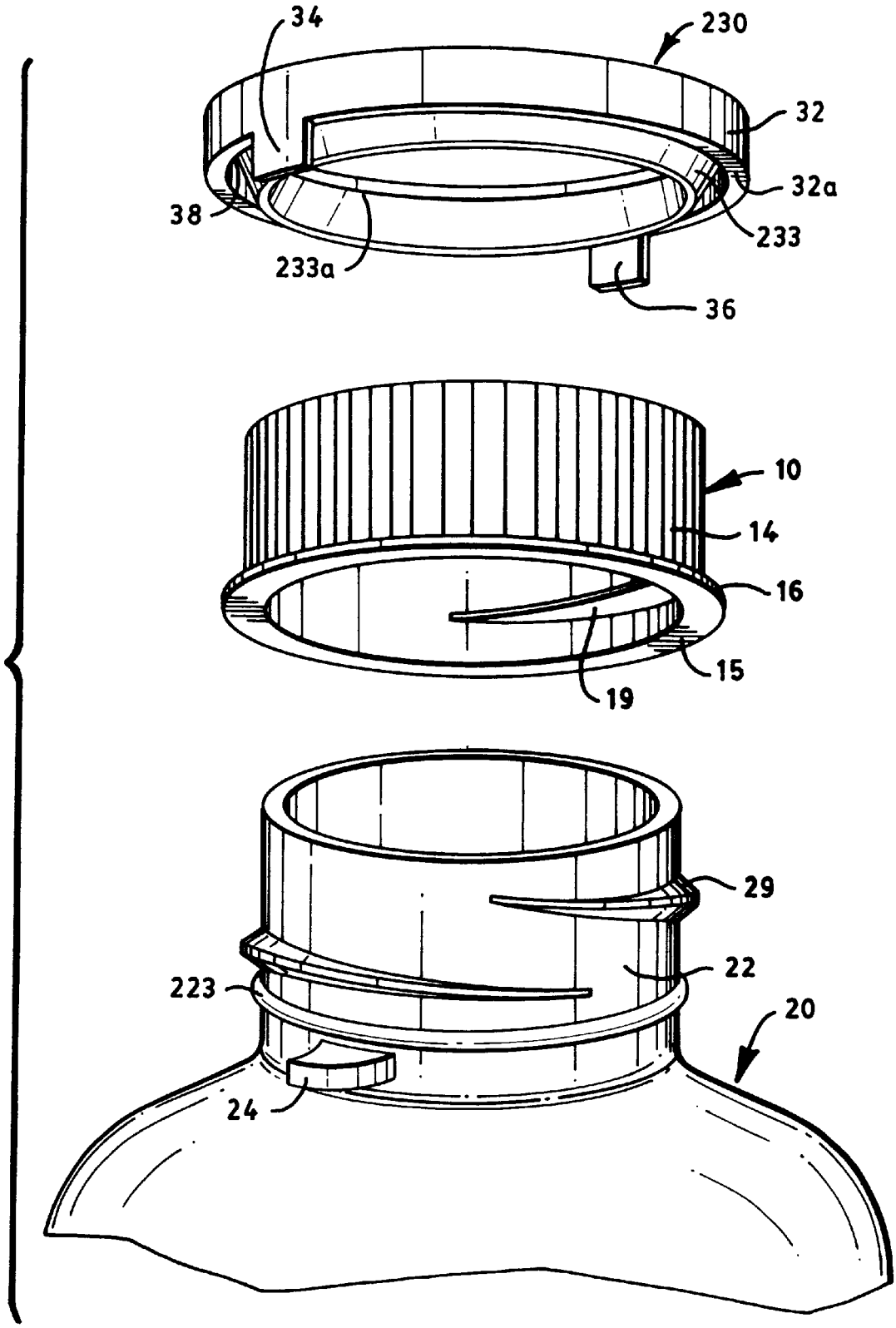
FIG. 10 is an exploded perspective view of an adapter band according to another alternative embodiment of the present invention shown with a non-child-resistant closure and container neck portion.
Figure 11:
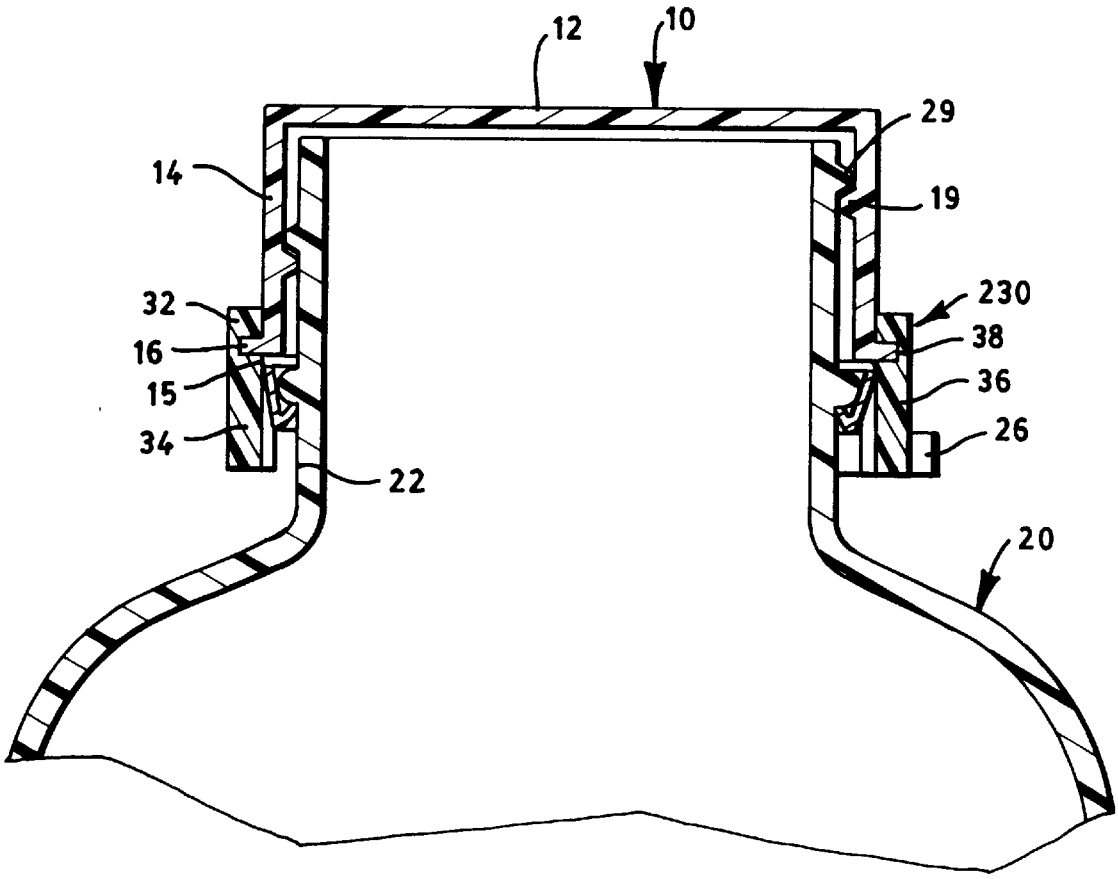
FIG. 11 is a section view of the adapter band of FIG. 10, shown attached to the non-child-resistant closure and affixed to the container neck portion, and shown taken along a section line coincident to a diameter thereof.
Figure 12:
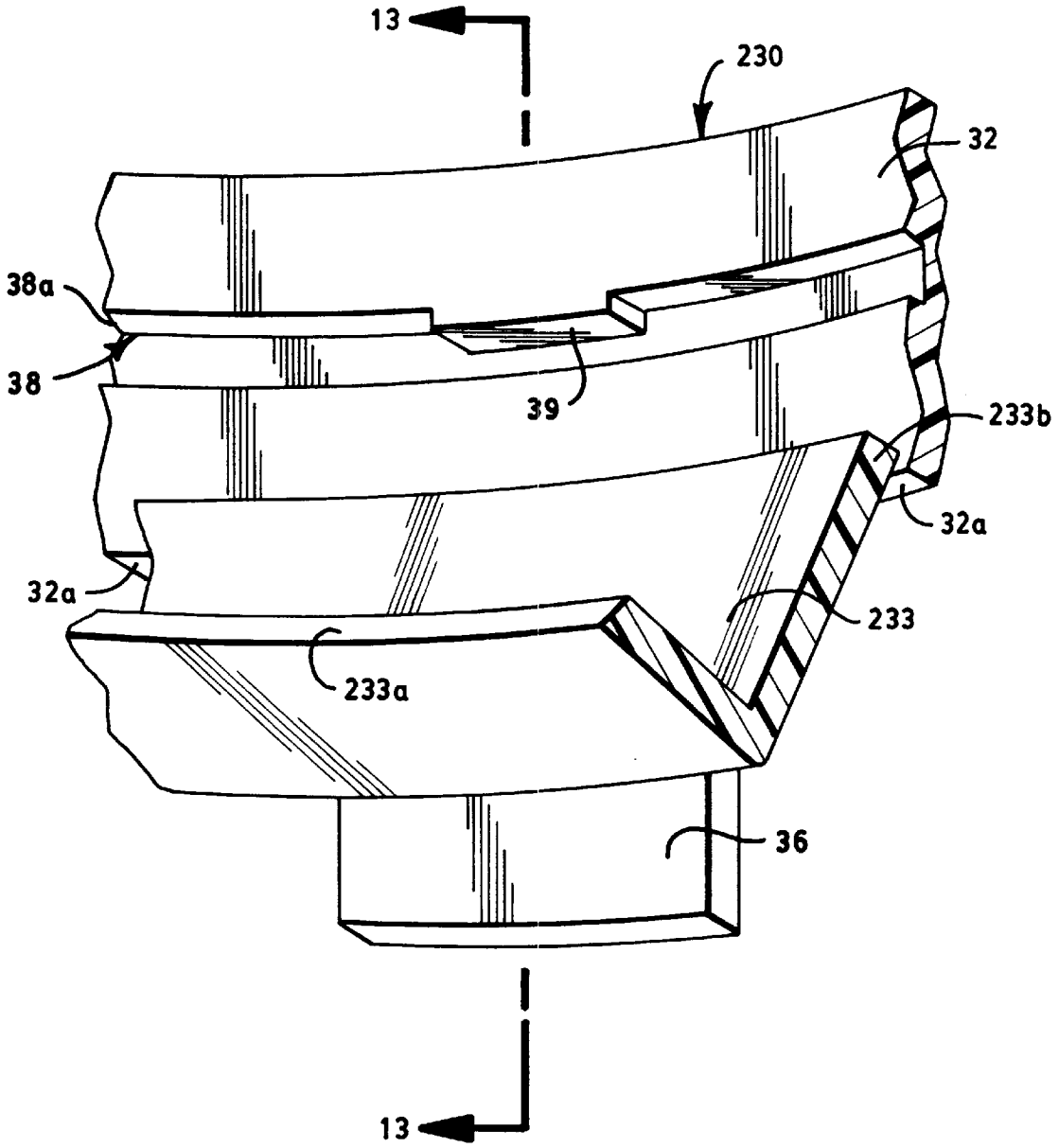
FIG. 12 is a detail section view of one portion of the adapter band of FIG. 10.
Figure 13:
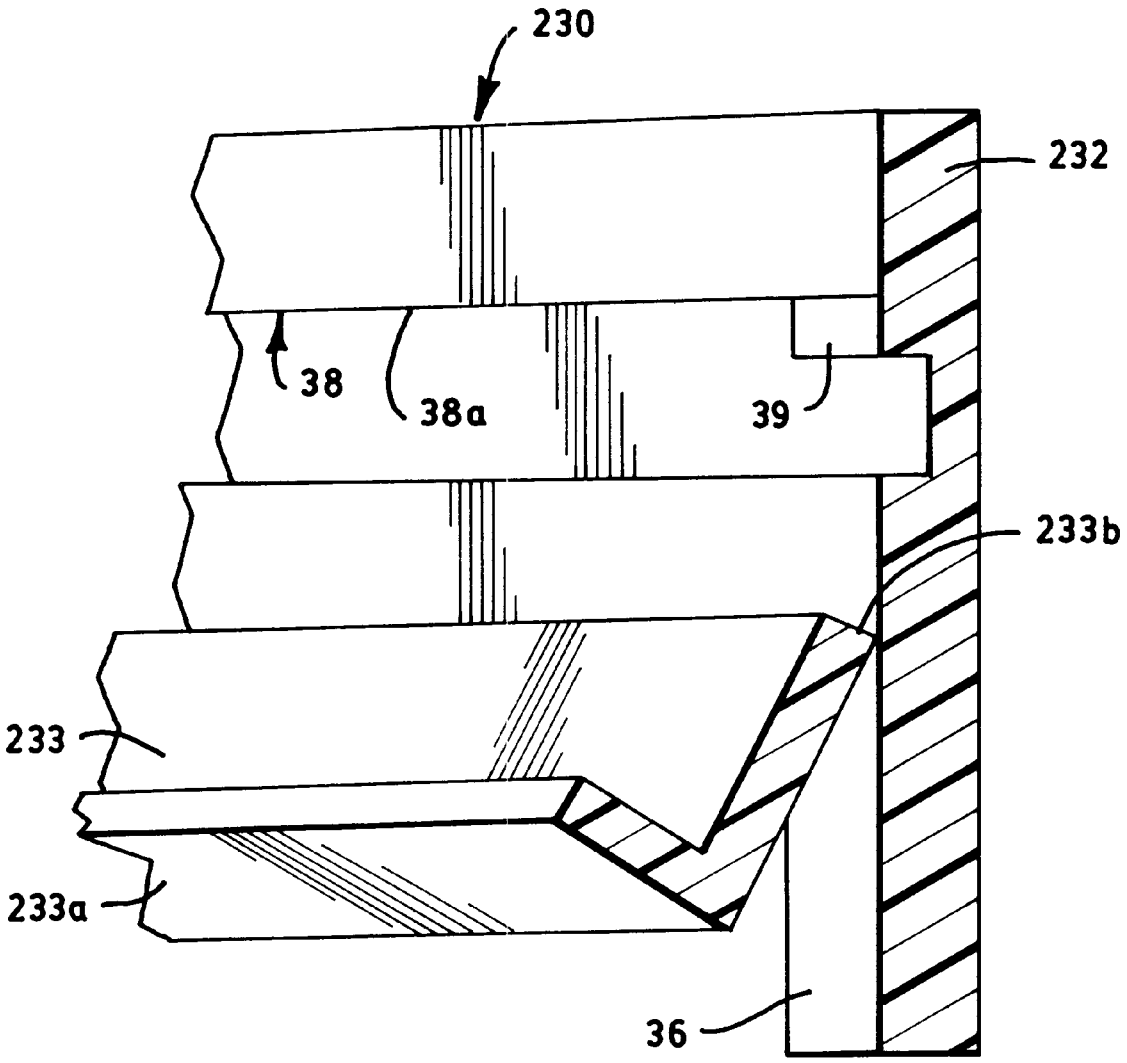
FIG. 13 is a detail section view of the adapter band of FIG. 12, shown taken along section line 13—13 of FIG. 12.

With reference to FIGS. 8 and 9, an adapter band 130 according to an alternative embodiment of the present invention includes many parts in common with the preferred embodiment described hereinabove and like reference numerals are intended to represent like parts. More particularly, however, the locking tabs 34, 36 of the preferred embodiment have been replaced in the present embodiment with a locking arm 136 projecting outwardly in a substantially arcuate fashion from the side wall 32 of the adapter band 30. The locking arm 136 is integrally molded at a base end 136*a* thereof to a portion of the adapter band side wall 32 and includes a substantially free outer end 136*b* thereof connected to another portion of the side wall 32 by a resilient bridge member 134, integrally molded therewith.

The adapter band 130 is secured to a closure 10 as hereinabove described and the closure 10 having the adapted band 130 secured thereto is threadingly affixed to a container neck portion 22 being provided with means for engaging the locking arm 136, such as, for example, a locking lug (not shown), to inhibit removal of the closure 10 therefrom. The locking arm 136 is radially-inwardly flexible about the base end 136*a* thereof by applying inwardly-directed radial force to the locking arm 136 near the outer end 136*b* thereof. Sufficient radial force is applied to the locking arm 136 for the outer end 136*b* thereof to overcome the locking means provided on the container neck portion 22. The resilient bridge member 134 returns the locking arm 136 to a normally-outward orientation once the radial force is removed therefrom.

With reference to FIGS. 10–13, an adapter band 230 according to another alternative embodiment of the present invention includes many parts in common with the adapter band 10 according to the preferred embodiment described hereinabove and like reference numerals are intended to represent like parts. More particularly, however, the adapter band 230 is snap-fit onto an annular lip 16 provided on a closure 10 and secured thereto as described hereinabove to prevent relative rotational movement therebetween, such as, for example, by providing a plurality of lugs 39 depending downwardly from an upper surface 38*a* of a continuous groove 38 provided in the adapter band side wall 32. The closure 10 is threadingly attached to a neck portion 22 of a container 20 and secured thereto by engagement of a pair of adapter band locking tabs 34, 36 with cooperating container neck portion locking ramps 24, 26 (FIG. 1).

Even further, the adapter band 230 according to the present embodiment includes a tamper-indicating band 233 integrally molded with a lower end 32*a* thereof, depending downwardly and inwardly therefrom. Preferably, the tamper-indicating band 233 includes an upturned portion 233*a* sized to engage a continuous bead 223 projecting radially outwardly from the container neck portion 22. The tamper-indicating band 233 is positioned such that the upturned portion 233*a* thereof snaps below an underside surface of the continuous bead 223 simultaneously with the locking tabs 34, 36 seating behind the locking ramps 24, 26 as the closure 10 with attached adapter band 230 being threadingly affixed downwardly onto the container neck portion 22.

Removal of the closure 10 with attached adapter band 230 is accomplished as described hereinabove with respect to the preferred embodiment hereof. However, the tamper-indicating band 233 remains affixed to the container neck portion 22 after the closure 10 is removed a first time therefrom. More particularly, the tamper-indicating band 233 is prevented from upward travel therewith by the upturned portion 233*a* thereof being firmly seated under the continuous bead 223 provided on the container neck portion 22. Upon application of sufficient upward removal force, such as, for example, by unthreading the closure 10 from the container neck portion 22, the tamper-indicating band 233 breaks away from the adapter band 230 along an uppermost edge 223*b* defining the location where the tamper-indicating band 223 is integrally-molded with the lower end 32*a* of the adapter band side wall 32. The uppermost edge 223*b* may be either a continuous seam between the adapter band lower end 32*a* and the tamper-indicating band 233, or it may be comprised of a plurality of shortened arcuate contact segments, having arcuate spaces therebetween. The tamper-indicating band 223 remains attached to the container neck portion 22, and permanently disassociated from the adapter band 230, upon removal of the closure 10 from the container neck portion 22 a first time, thereby providing an indicator of the container's having been opened a first time.

Alternatively, a tamper-indicating band according to the present embodiment may be added to an adapter band having locking means similar to those described hereinabove and illustrated in FIGS. 8 and 9.

Figure 14:
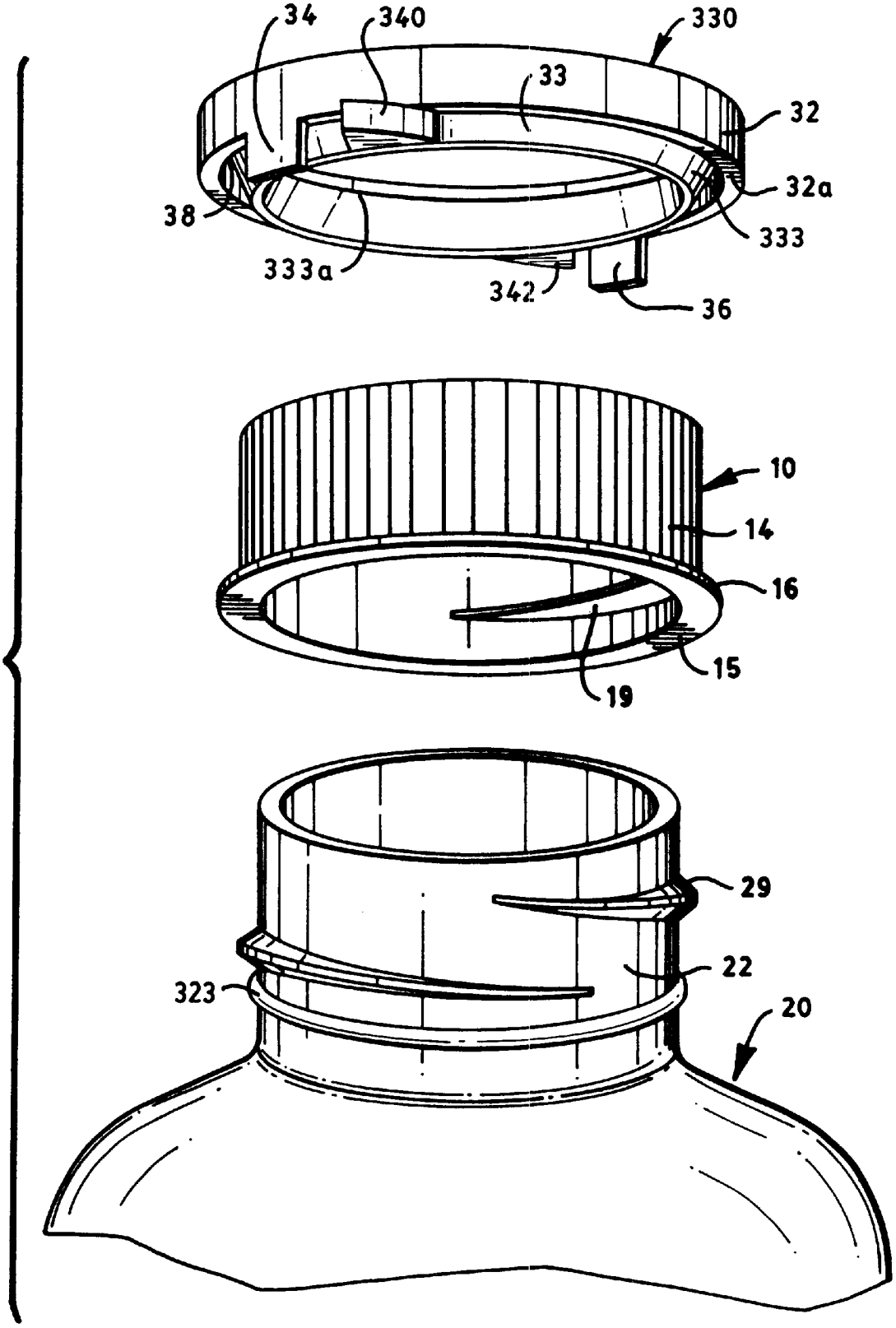
FIG. 14 is an exploded perspective view of an adapter band according to another alternative embodiment of the present invention shown with a non-child-resistant closure and a non-child-resistant container neck portion.
Figure 15:
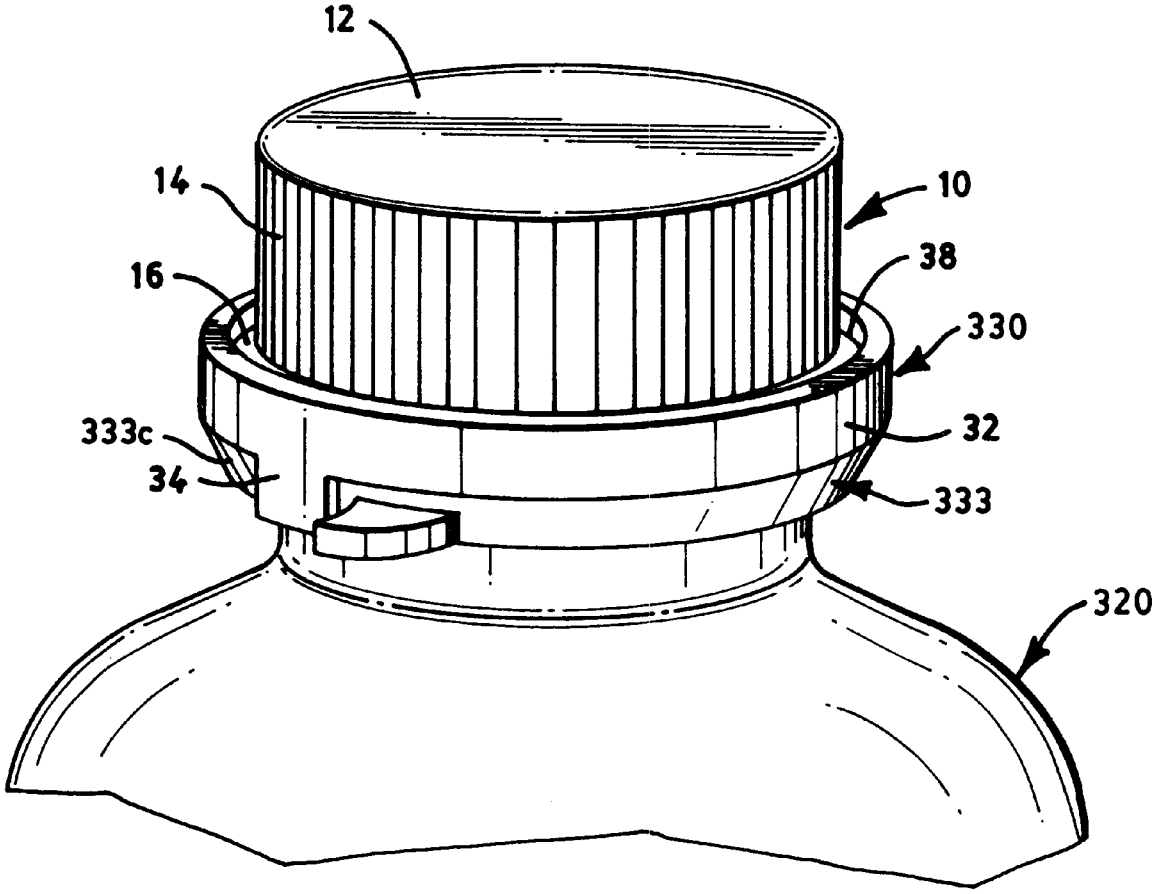
FIG. 15 is a perspective view of the adapter band of FIG. 1, shown attached to the non-child-resistant closure and affixed to the non-child-resistant container neck portion of FIG. 14, and shown assembled before removal therefrom a first time; and, FIG. 16 is a perspective view of the adapter band of FIG. 1, shown attached to the non-child-resistant closure and affixed to the non-child-resistant container neck portion of FIG. 14, and shown assembled after removal therefrom a first time.
Figure 16:
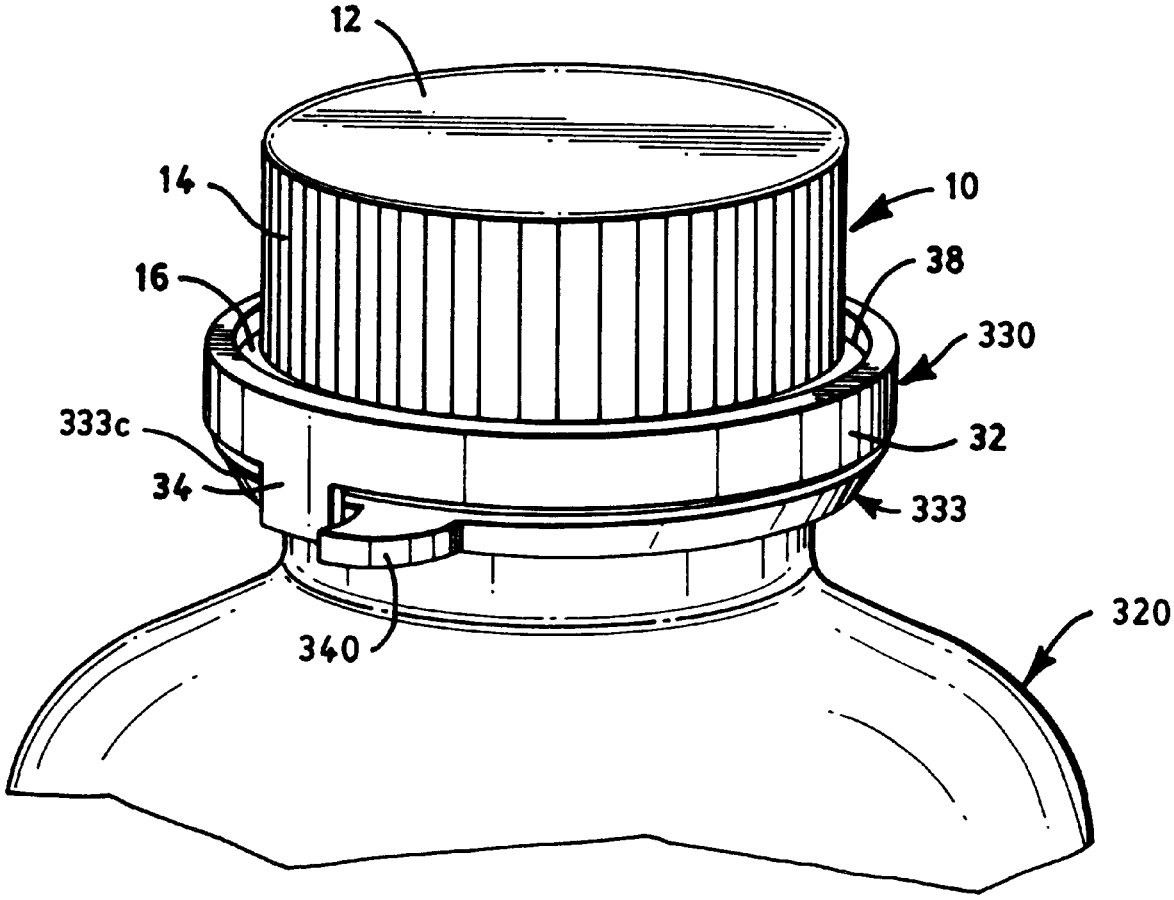

With reference to FIGS. 14–16, an adapter band 330 according to another embodiment of the present invention includes many parts in common with the adapter band 230 according to the previous embodiment described hereinabove and illustrated in FIGS. 10–13, and like reference numerals are intended to represent like parts. More particularly, the adapter band 330 is snap-fit onto an annular lip 16 provided on a closure 10 and secured thereto as described hereinabove to prevent relative rotational movement therebetween, such as, for example, by providing a plurality of lugs 39 depending downwardly from an upper surface 38*a* of a continuous groove 38 provided in the adapter band side wall 32. The adapter band 330 according to the present embodiment includes a pair of locking tabs 34, 36 and is for use on a container 320 not having integral means for cooperating with the locking tabs 34, 36 to prevent removal of the closure 10 therefrom. As such, the present embodiment is provided with means for securing in a child-resistant manner a non-child-resistant closure to a container neck portion not having integral means for cooperating therewith, thereby converting the container neck portion into one having child-resistant features.

The adapter band 330 according to the present embodiment includes a tamper-indicating band 333 integrally molded with a lower end 32*a* thereof, depending downwardly and inwardly therefrom. Preferably, the tamper-indicating band 333 includes a downturned portion 333*c* and an upturned portion 333*a* sized to engage a continuous bead 323 projecting radially outwardly from the container neck portion 22. The tamper-indicating band 333 is positioned such that the upturned portion 333*a* thereof snaps below an underside surface of a continuous bead 323 projecting radially outwardly from an outer surface of the container neck portion 22 as the closure 10 with attached adapter band 330 is threadingly affixed downwardly on the container neck portion 22.

Removal of the closure 10 with attached adapter band 330 is accomplished as described hereinabove with respect to the preferred embodiment hereof. However, the tamper-indicating band 333 remains affixed to the container neck portion 22 after the closure 10 is removed a first time therefrom. More particularly, the tamper-indicating band 333 is prevented from upward travel therewith by the upturned portion 333*a* thereof being firmly seated under the continuous bead 323 provided on the container neck portion 22. Upon application of sufficient upward removal force, such as, for example, by unthreading the closure 10 from the container neck portion 22, the tamper-indicating band 333 breaks away from the adapter band 330 along an uppermost edge 323*b* defining the location where the tamper-indicating band 323 is integrally-molded with the lower end 32*a* of the adapter band side wall 32. The uppermost edge 323*b* may be either a continuous seam between the adapter band lower end 32*a* and the tamper-indicating band 333, or may be comprised of a plurality of shortened arcuate contact segments, having arcuate spaces therebetween. The tamper-indicating band 323 remains attached to the container neck portion 22, and permanently disassociated from the adapter band 330, upon removal of the closure 10 from the container neck portion 22 a first time, thereby providing an indicator of the container's having been opened a first time.

The tamper-indicating band 333 is provided with a pair of locking ramps 340, 342 integrally molded with the downturned portion 333*c* thereof and projecting radially outwardly therefrom at diametrically-opposed annular locations. The locking ramps 340, 342 are sized to engage the locking tabs 34, 36 as described hereinabove with respect to the preferred embodiment hereof.

The upturned portion 333*a* may be provided with means for gripping the underside surface of the continuous bead 323 to prevent relative rotational movement therebetween. For example, the upturned portion 333*a* may be provided with a plurality of teeth, notches, slots, recesses, or the like, to grip the underside surface of the continuous bead 323, which may be provided with means for engaging same.

Alternatively, a tamper-indicating band according to the present embodiment may be added to an adapter band having locking means similar to those described hereinabove and illustrated in FIGS. 8 and 9.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

We claim:

1. An adapter band for use on a closure and engageable with a container neck, said closure having an outwardly protecting annular lip at a lower end, at least one recess provided in said annular lip, being threadingly engageable with said container neck, said container neck having at least one locking ramp projecting outwardly therefrom and a continuous bead projecting outwardly from said container neck, said adapter band comprising:

an annular ring having a groove on an inner surface thereof, said groove being sized to receive said annular lip;

means for preventing rotational movement between said annular ring and said closure including at least one locking lug projecting downwardly from an upper surface of said groove being sized to be received in said at least one recess; and, at least one locking tab projecting from said annular ring, said at least one locking tab being engageable with said at least one locking ramp.

2. The adapter band of claim 1, further comprising:

a tamper-indicating band projecting downwardly and inwardly from a lower end of said annular ring, said tamper-indicating band having an upturned portion thereof being engageable with said continuous bead.

3. The adapter band of claim 1, wherein:

said at least one locking tab depends downwardly from said lower end of said annular ring.

4. The adapter band of claim 1, wherein:

said at least one locking tab projects outwardly from an outer surface of said annular ring, said at least one locking tab having an outermost end thereof connected to said outer surface of said annular ring by a flexible bridge member.

5. An adapter band for use on a closure and engageable with a container neck, said closure having an outwardly projecting annular lip at a lower end, at least one recess provided in said annular lip, being threadingly engageable with said container neck, said container neck having an outwardly projecting continuous bead encircling said neck, said adapter band comprising:

an annular ring having a groove on an inner surface thereof, said groove being sized to receive said annular lip;

means for preventing rotational movement between said annular ring and said closure;

a tamper-indicating band projecting downwardly and inwardly from a lower end of said annular ring, said tamper-indicating band having an upturned portion thereof being engageable with said continuous bead to prevent relative rotational movement therebetween;

at least one locking ramp projecting outwardly from said tamper-indicating band; and, at least one locking tab projecting from said annular ring, said at least one locking tab engageable with said at least one locking ramp.

6. The adapter band of claim 5, wherein said means for preventing relative rotational movement between said annular ring and said closure comprises:

at least one locking lug projecting downwardly from an upper surface of said groove; and, said at least one locking lug projection being sized to be received in said at least one recess.

7. The adapter band of claim 5, wherein:

said at least one locking tab depends downwardly from said lower end of said annular ring.

8. An adapter band for use on a closure and engageable with a container neck, said closure having an outwardly projecting annular lip at a lower end and being threadingly engageable with said container neck, said container neck having at least one locking ramp projecting outwardly therefrom, and a continuous bead projecting outwardly therefrom, said adapter band comprising:

an annular ring having a groove on an inner surface thereof, said groove being sized to receive said annular lip;

means for preventing rotational movement between said annular ring and said closure;

at least one locking tab projecting from said annular ring, said at least one locking tab being engageable with said at least one locking ramp; and, a tamper-indicating band projection downwardly and inwardly from a lower end of said annular ring, said tamper-indicating band having an upturned portion thereof engageable with said continuous bead.

9. The adapter band of claim 8, wherein:

said at least one locking tab depends downwardly from said lower end of said annular ring.

10. The adapter band of claim 8, wherein:

said at least one locking tab projects outwardly from an outer surface of said annular ring, said at least one locking tab having an outermost end thereof connected to said outer surface of said annular ring by a flexible bridge member.

* * * * *

UNITED STATES PATENT AND TRADEMARK OFFICE

CERTIFICATE OF CORRECTION

PATENT NO. : 6,016,930
DATED : January 25, 2000
INVENTOR(S) : Mathes et al

It is certified that error appears in the above-identified patent and that said Letters Patent is hereby corrected as shown below:

Claim 1, col. 7, line 54, after groove, insert --and at least one recess provided in said annular lip, said at least one recess--;
Claim 5, col. 8, line 11, after lip, insert --at a lower end and--.

Signed and Sealed this

Third Day of April, 2001

Nicholas P. Godici

*Attest:*

NICHOLAS P. GODICI

*Attesting Officer*

*Acting Director of the United States Patent and Trademark Office*